US005253943A

United States Patent [19]

Miyashita

[11] Patent Number: 5,253,943

[45] Date of Patent: Oct. 19, 1993

[54] PLASTIC CLIPBOARD HAVING ELASTIC ENGAGING PINS

[75] Inventor: Muneharu Miyashita, Inuyama, Japan

[73] Assignee: Yazaki Industrial Chemical Co Ltd., Shizuoka, Japan

[21] Appl. No.: 953,916

[22] Filed: Sep. 30, 1992

[30] Foreign Application Priority Data

Oct. 31, 1991 [JP] Japan ..... 3-097989

[51] Int. Cl.[5] ..... B42F 13/12; B42F 13/36

[52] U.S. Cl. ..... 402/68; 402/80 P; 281/43; 281/44

[58] Field of Search ..... 281/43, 44, 45; 402/60, 402/62, 68, 69, 80 R, 80 P; 24/3 L, 44

[56] References Cited

U.S. PATENT DOCUMENTS

| | | | |
|---|---|---|---|
| 415,189 | 11/1889 | Cumingham | 402/60 |
| 647,143 | 4/1900 | Marshall | 281/43 |
| 869,379 | 10/1907 | Mills | 281/43 X |
| 1,008,047 | 11/1911 | Mooney | 402/60 |
| 1,133,655 | 3/1915 | Morgan | 281/43 |
| 1,841,903 | 1/1932 | McGonigle | 281/44 X |

FOREIGN PATENT DOCUMENTS

| | | | |
|---|---|---|---|
| 898869 | 12/1953 | Fed. Rep. of Germany | 281/43 |
| 102762 | 1/1924 | Switzerland | 281/43 |

*Primary Examiner*—Mark Rosenbaum
*Assistant Examiner*—Peter Dungba Vo
*Attorney, Agent, or Firm*—Eric P. Schellin

[57] ABSTRACT

A clipboard for holding worksheets is disclosed, which is a plastic rectangular board bent into a largely inverted U-shaped cross-section having a vertical front board, an also vertical backside board that is larger in length than the front board, and a horizontal top roof member between the front and backside boards. A book of worksheets is clamped between the front and backside boards below the roof member. A hook for hanging the clipboard is centrally fixed in the roof member and having means t orient the clamped worksheets in two alternative different vertical planes perpendicular to each other. A pair of bosses centrally mounted in the backside board and each having at a front end thereof a downwardly inclined end face for engagement with a pair of apertures formed in the front board through a pair of holes in an upper margin of each worksheet clamped.

3 Claims, 8 Drawing Sheets

PLASTIC CLIPBOARD HAVING ELASTIC ENGAGING PINS

BACKGROUND OF THE INVENTION

1) Field of the Invention

This invention relates in general to a clipboard for holding worksheets at factory production lines, and in particular to clipboards conveniently used in such situations where miltiple worksheets carrying a great deal of instructions for the work has to be quickly handled in limited space as automobile assembly lines designed for standardized projects covering a wide range of models and kinds.

2) Description of the Prior Art

In automobile production lines where a series of assembling operations are carried out on individual car bodies, as they are moved along on a conveyor belt, according to standardized schemes, a complete body of computer-processed instructions for each product, presented in about 10 worksheets, has to be rapidly surveyed and precisely followed by factory employees at work. The workers are required to do the automobile assembling just assigned to them in the correct sequence of steps while looking through the worksheets giving the instructions in an orderly manner.

Conventionally, when a worker is supplied with a whole set of sheets of instructions for his work, say, at an automobile production line, the sheets may be individually taped in or on the work, or an automobile, at locations where they are empirically believed to be convenient for the specific operation or set of operations assigned. Otherwise, the all sheets may be put in the stacked form at a specific place near the work site.

In either case, however, inconveniences involved have been found annoying. Since such worksheets are rather large, 37 centimeter wide and 38 centimeter long in most cases, a size intended to facilitate reading and handling, they take up large space when they are taped individually in different spots. In addition, detaching all the worksheets from taped places for submission to a factory supervisor or foreman at the end of the work is a time-consuming task. Furthermore, huge quantities of tape are consumed during the day's work, adding to production costs. Where the whole worksheets is placed in one and the same place throughout the work, they often come to fall out of sight for the worker when he is at work away from the previous operations.

SUMMARY OF THE INVENTION

The present invention has therefore been proposed to eliminate the above-mentioned and other possible drawbacks of the conventional practices, which provides a clipboard to hold a number of worksheets easily removably and in a manner that enables factory workers to manipulate them conveniently.

The clipboard of this invention also contribute to reducing costs because it needs no use of adhesive tape. The above-mentioned advantages and other features of the present invention are provided by a clipboard for holding a number of worksheets which is a plastic rectangular board bent into a largely inverted U-shaped cross-section having a vertical front board, an also vertical backside board that is larger in length than the front board, and a horizontal top roof member interposed between the front and backside boards.

A book of worksheets is clamped between the front and backside boards below the roof member. A hook for hanging the clipboard is centrally fixed in the roof member and having means to orient the clamped worksheets in two alternative different vertical planes perpendicular &o each other. A pair of engaging bosses centrally mounted in the backside board and each having at a front end thereof a downwardly inclined end face for engagement with a pair of apertures formed in the front board through a pair of holes formed centrally in an upper margin of each worksheet clamped.

In a second preferred embodiment of the present invention, a clipboard is substantially similar in shape to the one mentioned above expect for the paired engaging bosses, which are replaced by a pair of pins each having at a middle part thereof a collar that stops the associated pin, when it is inserted from front through the apertures in the front board, at a point where the pins have their forward ends just engaged in another pair of openings bored in the backside board, at locations just opposite the paired apertures of the front board.

In a third embodiment, the clipboard comprises a flat vertical rectangular backing board and a horizontally extending inverted-U cross-section hood member made of a thin material comprising a front apron and a rear apron. The front apron is movably hinged at an upper end thereof to the rear apron, and forms, in conjunction with the rear apron, means to hold a book of worksheets against the backing board.

The front apron pivots about its hinged upper end to alternatively assume either a first open position where the front apron is raised away from the rear apron or a second closed position where the front apron is lowered close to the rear apron to clamp the worksheets therebetween. A pair of pegs are formed in an inside wall of the front apron on the side of the rear apron and a pair of sleeves are mounted in the rear apron, at locations opposite the paired pegs. In this arrangement, when the front apron is lowered to the second position, with a bunch of worksheets held in position against the backing board, the paired pegs are caused to pass into the paired sleeves through a pair of holes centrally formed in an upper margin of each worksheet clamped.

DETAILED DESCRIPTION OF PREFERRED EMBODIMENTS

Preferred embodiments of the present invention will be described in great detail in conjunction with the attached drawings.

Figure 1:
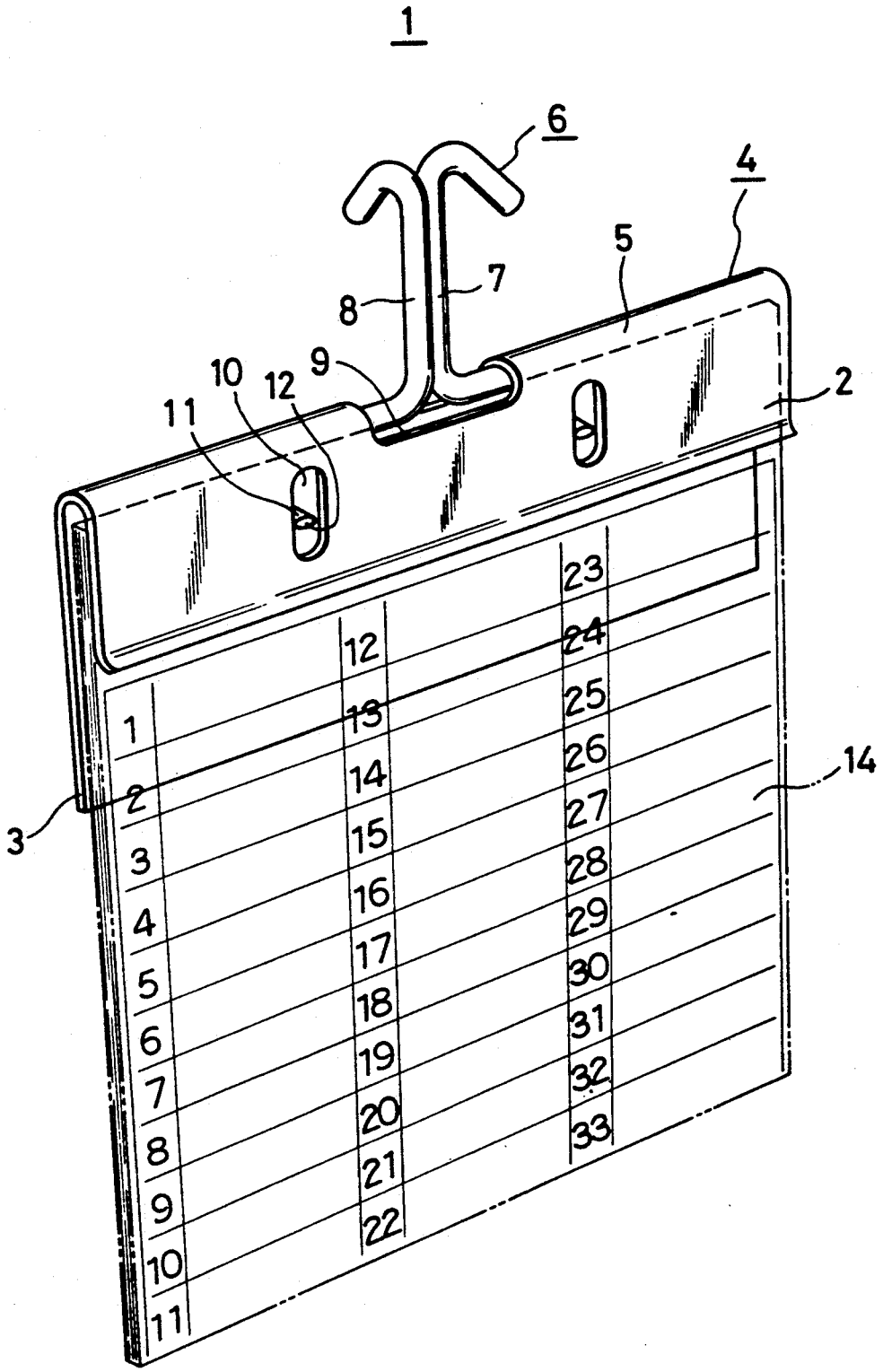
FIG. 1 is a perspective view of a clipboard according to a first preferred embodiment of the present invention.
Figure 2:
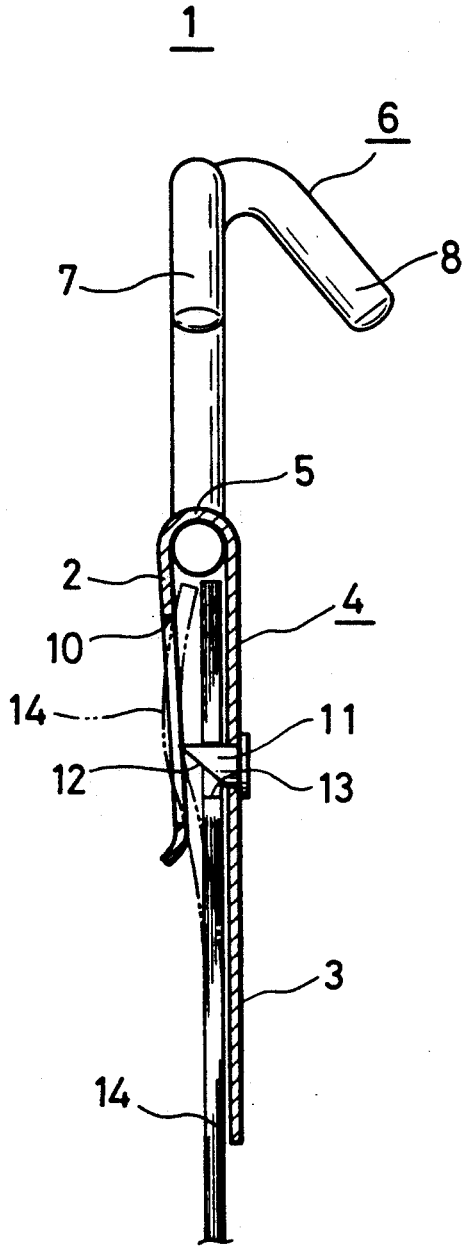
FIG. 2 is a side view of the clipboard of FIG. 1.

FIG. 1 is a perspective view of the clipboard 1 according to a first preferred embodiment of the present invention, and FIG. 2 is a side cross-sectional view of the clipboard of FIG. 1. The clipboard 1 includes measures to clip paper, such as a worksheet 14 carrying a set of instructions for factory workets to follow in assembling products, and a hook 6 to hang the clipboard with the worksheets at proper positions in the working site.

As shown in the FIGS. 1 and 2, the clipboard 1 comprises a main body 4 that may preferably be built by longitudinally bending a rectangular plastic board into a structure of inversely U-shaped cross section composed of a vertical front board 2, an also vertical backside board 3, and a horizontal top roof 5 interposed therebetween, the rectangular plastic board may preferably be a transparent acryl resin approximately 1 millimeter in thickness. The front board 2 is made smaller in length than the backside board 3. The front board 2 and backside board 3 are adapted to embrace below the horizontal roof 5 a bunch of worksheets 14, an upper part of which is clamped between the front and backside boards.

A hook 6 is provided for hanging the clipboard 1 and centrally mounted on top of the horizontal roof 5.

The hook 6 may preferably be made of a pair of rods each bent an angle much sharper than 90 degrees and comprises a righthand hook member 7 and a lefthand hook member 8. The righthand hook member 7 is oriented in substantially the same plane as the clipboard 1 while the lefthand hook member 8 is directed in to a plane substantially perpendicular with the plane of the righthand hook member 7, as can be best shown in FIG. 2. The arrangement of the hook 6 is designed to provide a greater freedom in orientation of the clipboard 1 such that, when the lefthand hook member 8 is used to hang the clipboard 1, the worksheets supported on the backside board 3 is faced in a direction substantially perpendicular to the direction in which the worksheets would face when the righthand hook member 7 is employed.

The righthand hook member 7 and the lefthand hook member 8 may preferably be made integral through their stem portions, as illustrated in FIG. 1, to secure the rigidity of the entire structure of the hook 6. In addition, the vertical hook 6 may preferably have a pair of horizontally and oppositely extending elongate legs which are inserted into the main body 4 beneath the horizontal roof 5 through a cutout 9 centrally formed in the roof thereby fixing rigidly the hook to the main body of the clipboard 1.

The front board 2 may preferably have a lower edge thereof outwardly turned up to facilitate the insertion of a worksheet 14 or a batch of such sheets 14 to be clamped in the clipboard 1 into the gap between the front and backside boards. Also, the front board 2 has in an central part thereof a pair of elliptical apertures 10 bored at locations substantially equally distanced from the cutout 9 in the horizontal roof 5.

The main body 4 also includes a pair of engaging bosses 11 which may be affixed to the backside board 3, at locations just opposite the elliptical apertures 10. It is so designed that the engaging bosses 11 extend forwardly from the backside board 3 slightly upwardly toward their corresponding apertures 10 where the bosses each have a forward end thereof lightly engage in the apertures 10. The forward ends of the bosses may preferably be cut to have an downwardly tilted end face as shown in FIG. 2, for the reason described later.

It should be understood that worksheets 14 used with the clipboard 1 of this invention are provided in an upper margin part thereof with a pair of holes 13, at locations just opposite the paired apertures 10 when the sheets 14 are inserted into position in the clipboard. The clipboard 1 permits the insertion of a book of worksheets 14 up through the gap defined between the front board 2 and the backside board 3. The worksheets 14, while going through the gap between the boards, may either slide along the surface of the backside board 3 and smoothly over the slanted end forward end faces 12 of the engaging bosses 11, possibly causing the elastic front board 2 to bulge outwardly until the sheets are pushed full length into place in the clipboard 1. In the process, the engaging bosses are forced to move up and then back again in their home apertures 10 in the front board 2.

It may otherwise happen that the bunch of worksheets 14 may squeeze wiggling up the gap themselves elastically bulging outwardly around the apertures 10, as shown by dotted line in FIG. 2, as when the bunch of worksheets 14 is not bulky enough to develop the momentum to push aside the front board 2. In this way, the engaging bosses 11 prevent the clamped worksheets 14 from easily falling loose off the clipboard 1 during the operation.

Figure 3:
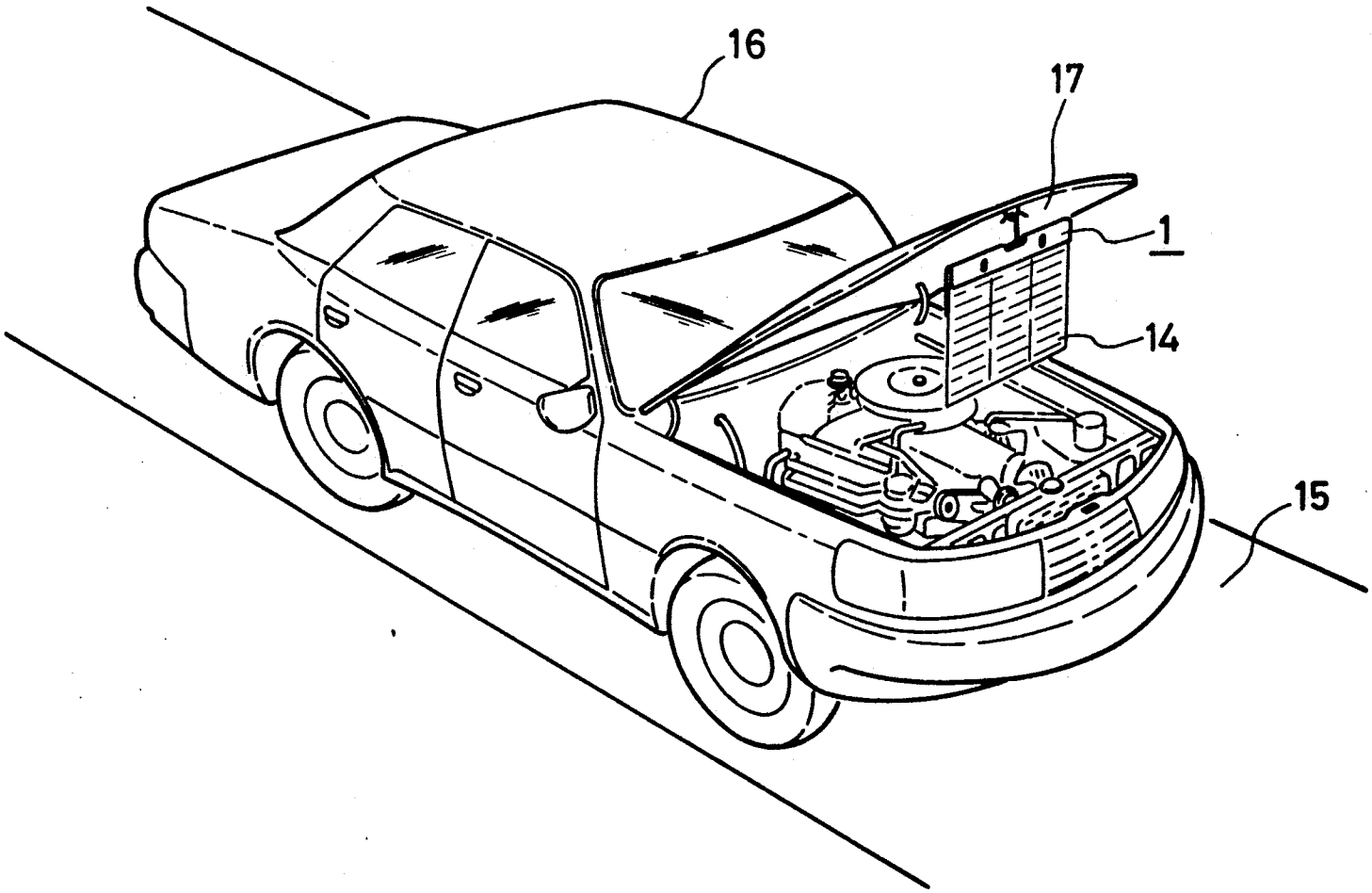
FIG. 3 is a perspective view of the clipboard of FIG. 1, illustrating how the device is employed.

In a factory production line, a clipboard 1 loaded with worksheets 14 can be hanged by its hook 6 at a convenient place such as in the raised bonnet 17 of an automobile 16 that may be carried along on a moving slat conveyor 15, as shown in FIG. 3. By using either of the righthand hook member 7 or the lefthand hook member 8 of the hook 6 to hang the clipboard 1, the worksheets 14 can be oriented in the desired direction for the operator at work on the automobile. After one worksheet 14 is finished after another, it can be pulled off the clipboard 1 manually as the sheet 14 can easily yield to the pull of a hand and come loose as the paper is ready torn from their paired holes by the engaging bosses 11.

Figure 4:
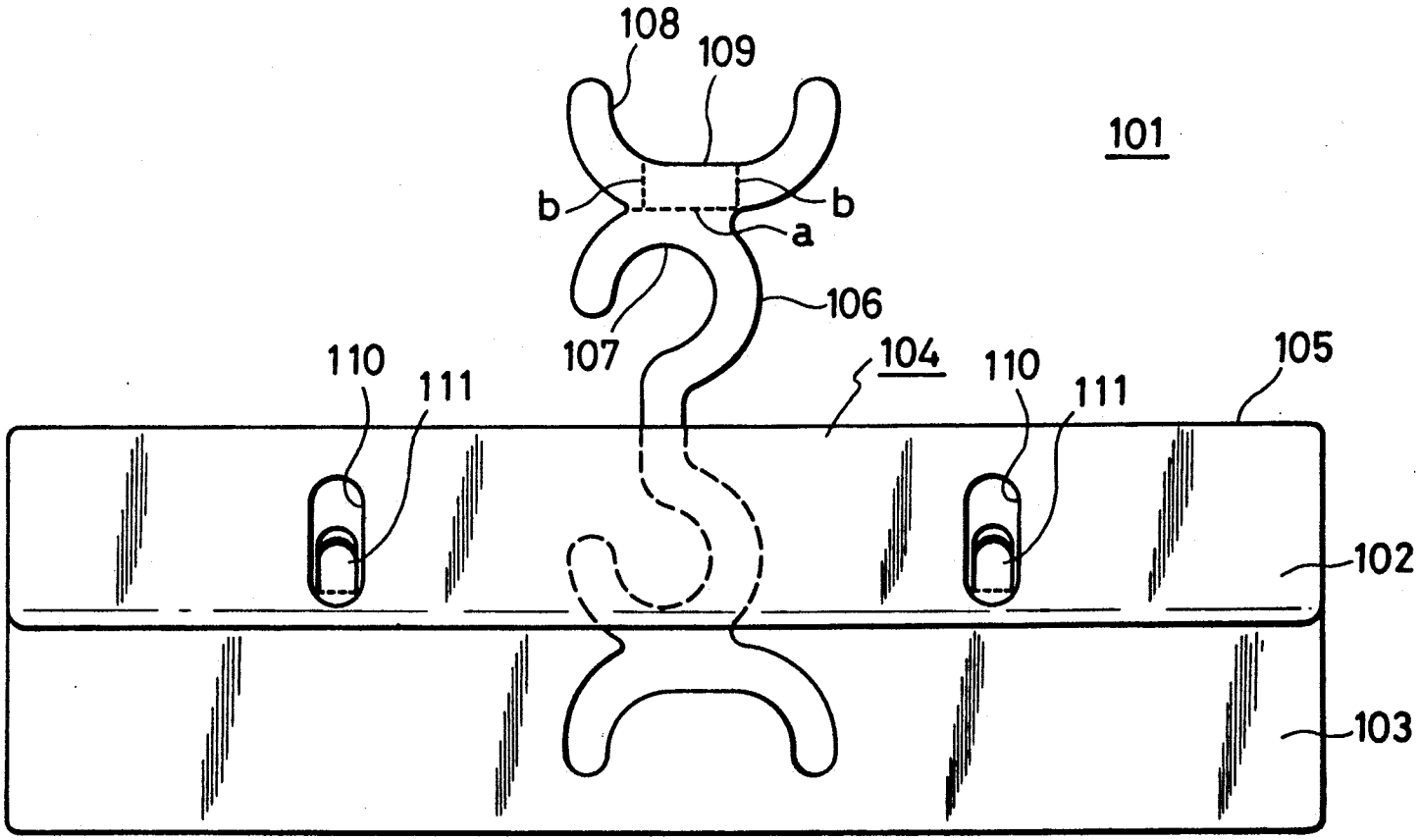
FIG. 4 is an expanded front view of a modified form of the clipboard of FIG. 1, showing only the core part thereof.
Figure 5:
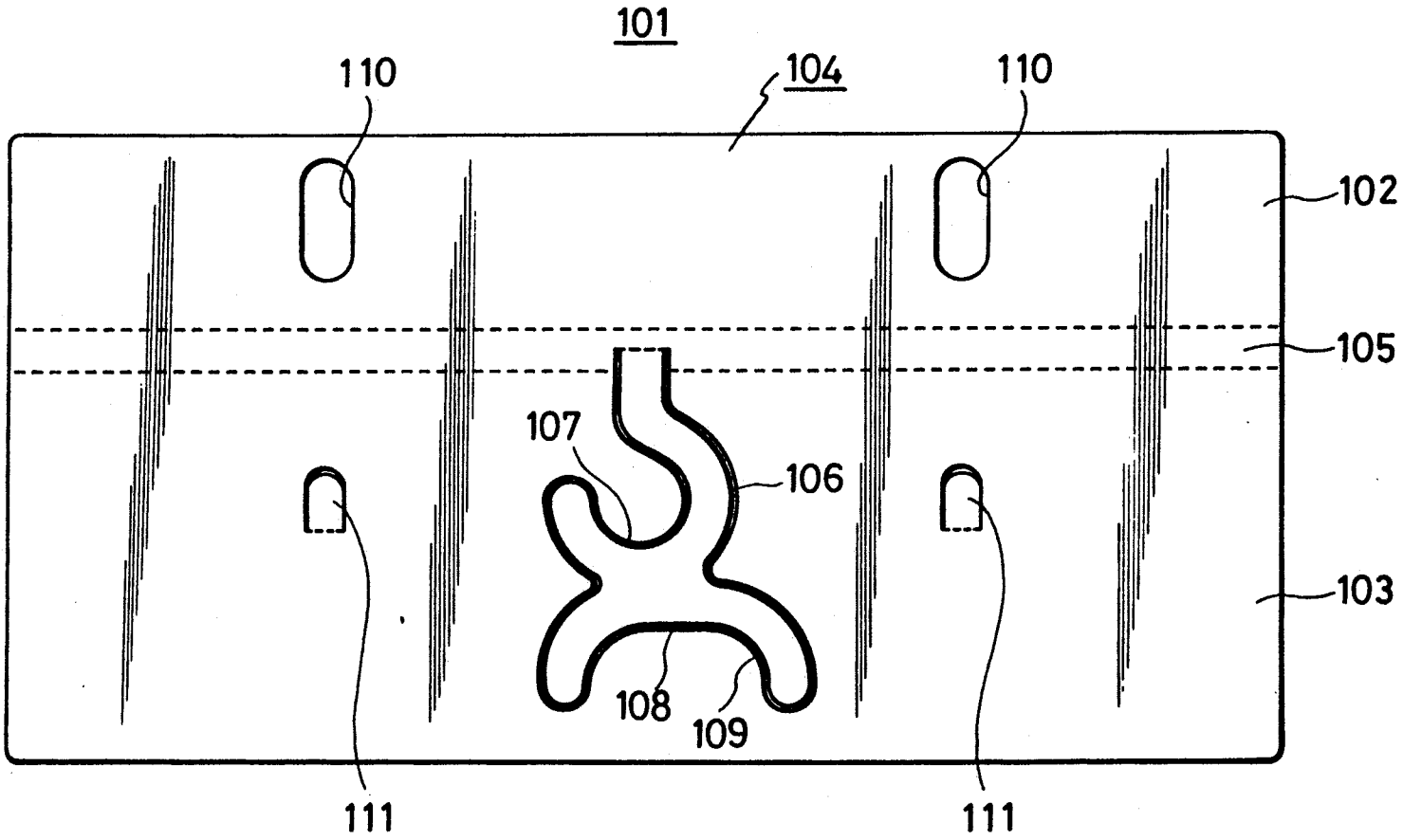
FIG. 5 is a spread-open view of the main body of the clipboard of FIG. 4, showing where the hook is cut out from the backside board.

Referring then to FIG. 4 which is a front view of a simplified modification of the embodiment of FIG. 1 showing only the upper core part of the main body, a clipboard 101 is virtually a single-piece device comprising a flat rectangular plastic material that makes up a main body 104 that is longitudinally bent, along dotted line of FIG. 5, into a largely inverted U-shaped cross section composed of a vertical front board 102, a vertical backside board 103 that is larger in length than the front board 102 and a top horizontal roof 105. A hook 106 is cut out from the backside board 103.

As shown in FIG. 5, which is a spread-open view of the main body 104, the hook 106 has a lowermost end part thereof left uncut and connected to a midpoint in the main body 104 where the backside board 103 borders on the roof section 105, so that hook 107 is raised upright in a central portion of the roof and thereby used to hang the clipboard 101.

In this embodiment, the hook 107 is built so that it can hang the clipboard 101 to face in either of two alternative directions. To this aim, the hook 101 comprises a lower question-mark shaped piece 107, an upper largely U-shaped piece 108 and an intermediate hook part 109 that virtually a bottom part of the upper piece.

The raised hook 106 from its cutout in the backside board 103 may be bent along dotted line "a" in FIG. 4, so that the upper hook piece 108 lies in horizontal position, substantially perpendicularly with the vertically standing lower hook piece 107. The horizontally oriented upper hook piece 108 is bent again along parallel dotted lines "b", until the bent left and right wings of the upper hook piece come to face the crimped part 105 of the clipboard 101, standing substantially perpendicularly with the still horizontally oriented intermediate hook piece 109. In this way, the bent upper hook piece 108 and the lower hook piece 107 of the hook 106 can both be used as a self-supporting hook to hang the clipboard 101. Using the lower hook piece 107 brings the sheets 14 held by the clipboard 101 to face in a direction different that would be perpendicularly when the clipboard was hanged with the upper hook piece 108.

A pair of elliptical apertures 110 are centrally formed in the front board. An inverted U-shaped engaging member 111 is also cut out in the backside board 103 and has a pair of a right engaging arm and a left engaging arm, at locations opposite the paired apertures 110. The cutout engaging member 111 is bent inwardly from the backside board 103 to bring their paired arms into light engagement with the paired apertures 110. The role of the engaging member 111 and the apertures 110 of this particular modification, along with their relationship with the worksheets 14 inserted into the clipboard 101, is essentially the same as that of the engaging bosses 11 and apertures 10 of the embodiment of FIG. 1, description is omitted here to avoid repetition.

Figure 6:
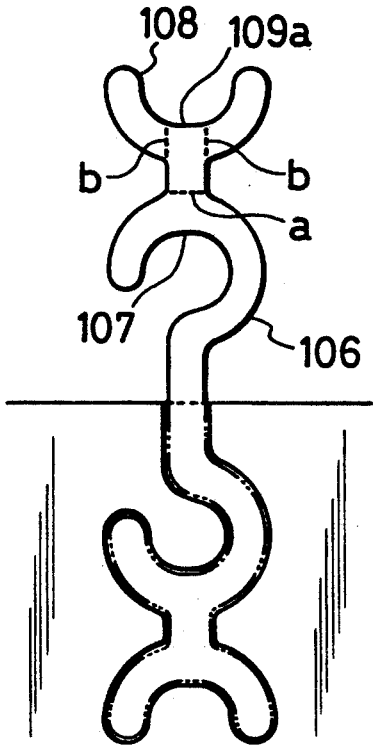
FIG. 6*a* is a modification of the hook of FIG. 5.
FIG. 6*b* is another modified form of the hook of FIG. 5.
Figure 6:
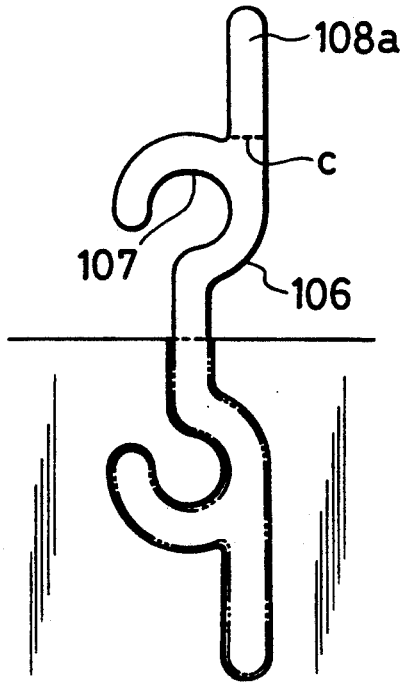

FIG. 6*a* is a modification of the hook of the preferred embodiment of FIG. 1, in which the intermediate hook piece 109 is centrally provided with a vertical extension connected to a top part of the lower hook member 107. This design provides greater freedom in cutting out the hook 106 out of the main body 101 than possible with the hook 6 of FIG. 1. Since the way of making dual hook members out of the hook 106 is essentially the same with the case of the preferred embodiment of FIG. 1, description is omitted for brevity's sake.

FIG. 6*b* is another modification of the hook 6 of FIG. 1, which a vertically extending piece 108 replaces the upper hook member 108 and the intermediate hook piece 109 of the earlier embodiment. The hook 106 of this particular modification can be bent along dotted line "c" to an angle smaller than 90 degrees with respect to the place of the lower hook member 106. Thus, while the lower hook member 106 forms a first hook, the bent piece 108 makes a second hook in a direction oriented perpendicular to the first hook.

Figure 7:
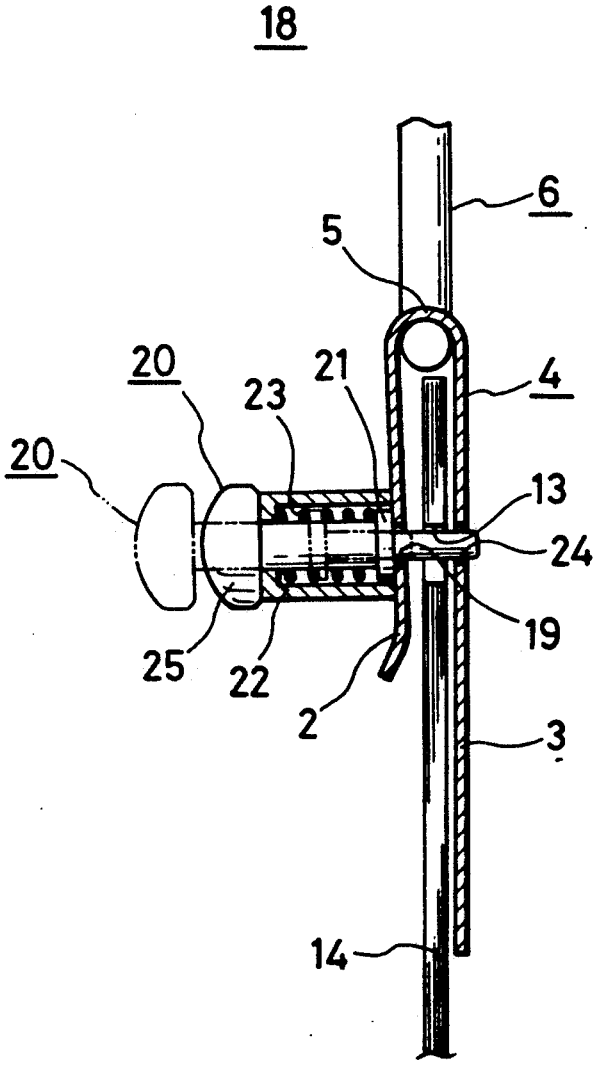
FIG. 7 is a side view of a clipboard constructed in accordance with a second preferred embodiment of the present invention.

With respect to FIG. 7, which is a side schematic view of a second preferred embodiment in accordance with the present invention, a clipboard 18 includes a pair of apertures 19 centrally bored in a front panel 2. Since the drawing is a side view, only one aperture 19 is shown, and description which follows will refer to that aperture. A pin 20 is provided in each aperture 19, and may preferably be removably inserted thereinto through a guide sleeve 22 that is fixedly secured around each of the apertures.

Also, a pair of bores 24 are drilled in a backside board 3, at locations aligned with the paired apertures 19. The clipboard 18 is built so that, when a worksheet 14 is inserted into place in the clipboard, the paired bores 24 are aligned with a pair of holes 13 centrally formed in an upper margin part of each worksheet clamped, along with the paired apertures 19. Each of the pins 20 may preferably be provided at a front end thereof with a flange 21 that stops the pin 20 in the associated sleeve 22 at a point where its front end is just inserted into the corresponding bore 24, as shown by bold line in FIG. 7. Each of the pins 20 may be provided with a knob 25 to facilitate manipulation thereof.

A compression spring 23 may preferably be snugly fitted in each of the sleeves 22 to urge the associated pin 20 toward its bore 24. When a book of worksheets 14 are set on the clipboard 18, the pins 20 are pulled up from their bores 24 against the force of the compression springs 23. After shoving the worksheets 14 into position in the clipboard 18, the pins 20 are pressed into the bores 24, clamping the worksheets securedly between the front board 2 and backside board 3. It should be understood that other parts of this particular embodiment are essentially the same as like components of the clipboard according to FIG. 1, and they are not be particularly mentioned here to avoid repetition of explanation.

Although the description for the second preferred embodiment is confined to the clipboard 4 made of a rectangular plastic plate, it should be understood that the present invention should also be applicable to a clipboard made of a non-plastic material.

Figure 8:
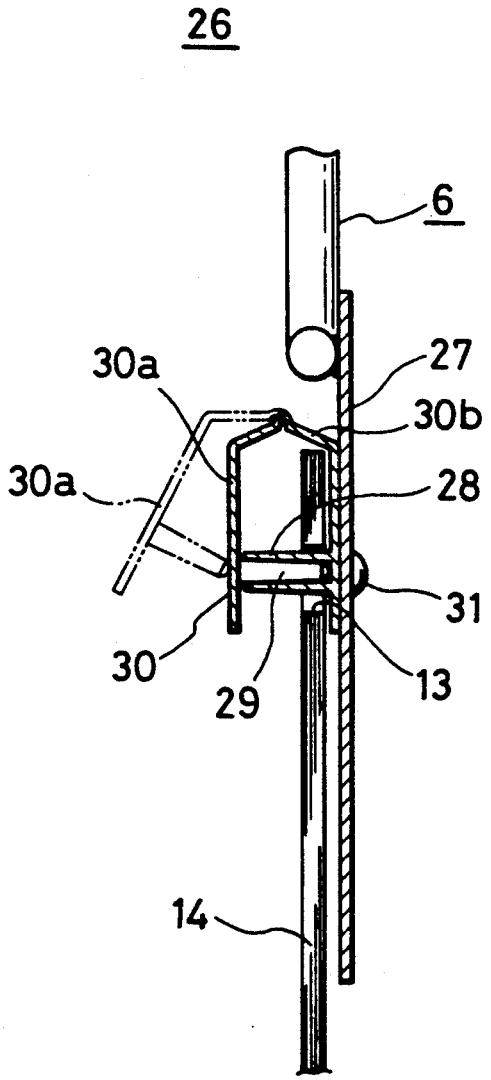
FIG. 8 is a side view of a clipboard constructed according to a third preferred embodiment of the invention.

Referring then to FIG. 8, which is a side schematic view of another preferred embodiment of the present invention, a clipboard 26 comprises a main body 27 made of a flat rectangular board. The main body 27 is centrally provided at an upper part thereof with a hook 6, which is substantially similar in design and function to the hook of the first or second preferred embodiment. Thus, description of the hook 6 for this particular embodiment will be omitted to avoid repetition.

A hood member 30 made of a thin material is provided, which comprises a first hood member 30*a* and a second hood member 30*b* are provided mounted on one side of the main body 27. The hood member 30 is adapted to clamp a bunch of worksheets between the first hood member 30*a* and second hood member 30*b* against the main body 27. The second member 30*b* is secured to that side of the main body 27 and has a pair of guide sleeves 28 (only one sleeve is shown in the drawing), each of which may preferably be affixed in position by a rivet 31 that is inserted through the main body 27 into the bottom of the sleeve.

The first member 30*a* is hinged at an upper end thereof to the second member 30*b* and is made pivotable about that hinged upper part to alternatively take a first open position, as shown by broken line of FIG. 8, where the first member is raised away from the second member, or a second close position as depicted by solid line of the same drawing where the first member is lowered close to the second member. A pair of pegs 29 are provided at a lower inside portion of the first member, at locations aligned with the paired sleeves 28, so that the first member 30*a* is moved to its closed position, the pegs 29 are inserted into their corresponding sleeves 28.

The first member 30*a* is lifted to the open position to allow a bunch of worksheets 14 to set on the clipboard 26. Then, the first member 30*a* is lowered to the closed position, the pegs 29 are inserted into the sleeves 28 through a pair of holes 13 centrally formed in an upper margin of each worksheet, thereby holding the worksheets in secured position in the clipboard 26.

Other parts of this particular embodiment are substantially the same as like components of the embodiment illustrated in FIG. 1, and their description is omitted to avoid repetition.

It will be evident from the above explanation that the clipboard of the present invention is capable of holding a desired number of worksheets securely at once, allowing filled sheets to be removed by simply pulling off from the clipboard. In addition, the clipboard has a hook which permits the clamped bunch of worksheets to orient in an alternative direction for easy sighting, particularly where the surrounding space is limited. The clipboard is also designed for mounting and dismounting easily at almost any place, without using adhesive tape as in conventional cases. This will definitely contribute to saving costs at production lines.

What is claimed is:

1. A clipboard for holding sheets of instructions comprising a main body that is formed by bending a flat rectangular plastic material longitudinally into a structure of largely inversed U-shaped cross-section having a vertically extending front board, vertically extending backside board that is larger in length than and facing opposite the front board and a horizontal top roof member interposed between the parallel front and backside board, and a horizontal top portion between the front and backside board, the front and backside boards being adapted in combination to releasably clamp a bunch of identical worksheets therebetween, and a hook centrally mounted in the top roof member and adapted to hang the clipboard, the hook having means to orient the clipboard in two alternative vertical planes perpendicular to each other whereby the clamped worksheets held beneath the horizontal roof member can be selectively faced in either of two directions, and a pair of engaging pins planted in an upper center portion of the backside board and each having a forward end thereof adapted for engagement with a pair of apertures bored in the front board, at locations just opposite the paired engaging pins, the paired engaging pins being adapted to elastically buldge out the worksheets around the aperture, and penetrate a pair of holes centrally formed in an upper margin part of each worksheet clamped, when the worksheets are inserted into position in the main body.

2. A clipboard as set forth in claim 1 wherein the paired engaging pins are bosses each cut to have a downwardly tilted forward end face to facilitate the insertion of worksheets into the gap defined between the front and backside boards.

3. A clipboard as set forth in claim 1 wherein the paired engaging pins are replaced by an inverted U-shaped member cut out in the backside board, the U-shaped member having a pair of vertical rightside and leftside arms bent forward into engagement with the paired openings in the front board.

* * * * *